United States Patent [19]

Carnahan et al.

[11] Patent Number: 4,908,252

[45] Date of Patent: Mar. 13, 1990

[54] PLEASANT-FEELING FRAGRANCE SAMPLER CONTAINING MICROCAPSULES

[75] Inventors: David W. Carnahan, Cartersville, Ga.; Edward I. Rabin, Westport, Conn.

[73] Assignee: Arcade, Inc., Chattanooga, Tenn.

[21] Appl. No.: 263,506

[22] Filed: Oct. 26, 1988

[51] Int. Cl.[4] ..... B32B 3/02

[52] U.S. Cl. ..... 428/27; 428/85; 428/280; 428/283; 428/402; 428/905

[58] Field of Search ..... 428/905, 85, 89, 92, 428/280, 402, 313.3, 87, 283

[56] References Cited

U.S. PATENT DOCUMENTS

| | | | |
|---|---|---|---|
| 4,226,944 | 9/1980 | Stone et al. | 428/905 |
| 4,345,716 | 8/1982 | Armstrong et al. | 428/905 |
| 4,514,461 | 4/1985 | Woo | 428/905 |
| 4,661,388 | 4/1987 | Charbonneau | 428/905 |
| 4,746,567 | 5/1988 | Zelter | 428/905 |

*Primary Examiner*—James J. Bell

*Attorney, Agent, or Firm*—Joseph H. Beumer

[57] ABSTRACT

A fragrance sampler for delivering and dispensing perfumes is disclosed. The sampler includes a sheet of synthetic pile fabric or other fabric with similar tactile properties having embedded therein microcapsules containing a fragrance oil. The fabric material, preferably made of a base sheet of polyethylene having segments of polyethylene fiber or strand aligned perpendicular thereto and prepared by means of a flocking process, provides a velvet-like texture that is pleasant to the touch, inviting the user to apply perfume by gently rubbing it on the skin. Microcapsules embedded in the fabric pile are ruptured by such rubbing, releasing a sample of the perfume. The sampler may be sealed by an impermeable film and may be removably connected to advertising material, such as brochures.

15 Claims, 1 Drawing Sheet

PLEASANT-FEELING FRAGRANCE SAMPLER CONTAINING MICROCAPSULES

FIELD OF THE INVENTION

This invention relates generally to fragrance sampling devices and more particularly to articles carrying rupturable microcapsules of perfume or fragrance materials.

BACKGROUND OF THE INVENTION

Various applications have been developed for microcapsules in which a core material such as a perfume, flavorant, or medicine is contained in an inert, rupturable capsule, typically having a particle diameter ranging upward from a few microns. Fragrance-delivery articles using microcapsules are disclosed in various prior patents, including British Patent Specification No. 1,329,309, wherein perfume-containing microcapsules are applied to paper sheets associated with printed advertising material. The perfume is said to be releasable from the microcapsules when they are fractured by application of pressure, as by scratching. Application of microcapsules to other materials, including plastics and metal foils, is also disclosed in this patent. It is furthermore known in the prior art to incorporate perfume-containing microcapsules within adhesive binder layers that break apart, rupturing the microcapsules upon pulling of a base sheet or folded over sheet, or within or on a low-strength layer of plastic that allows rupture of microcapsules upon being stretched.

Samples of the types described above provide for effective delivery of fragrances upon rupture of microcapsules, but they suffer from a limitation in that the sampler surface from which the fragrance is being released does not have favorable tactile properties. In the case of exposed adhesive surfaces, a distinctly unpleasant sensation would be created when such surface is rubbed against the skin. Paper and plastic sheets present a generally neutral feel and not a pleasant one such as would invite the user to apply the sampler to the skin. Effectiveness of fragrance-sample advertising would be increased by providing a sampler surface with a feel that induces the recipient of the sampler to take the additional step of applying it to the skin.

Samplers which have microcapsules in contact with paper sheets present an additional disadvantage in that the paper may contain various chemicals that migrate into the microcapsules and undergo reactions with the fragrance oils, distorting the fragrance aroma and reducing the shelf life of the sampler.

SUMMARY OF THE INVENTION

The present invention is directed to a fragrance sampler having a base sheet of material that is compressible and soft to the touch, and preferably synthetic pile fabric sheet material, impregnated with microcapsules containing a fragrance oil. Such a fabric presents favorable tactile properties, in particular, a cushion effect that results in a pleasant sensation to the user when rubbed on the skin. Gentle rubbing ruptures enough microcapsules to release an effective, but not overwhelming, amount of fragrance. Further rubbing will rupture additional microcapsules that are more deeply embedded, thus providing for repeated usage. The sampler may also include removable protective films on both faces of the base sheet as well as a connection to another sheet of printed advertising material by means of a perforated, tearable strip, allowing easy removal.

It is, therefore, an object of this invention to provide a fragrance sampling article having embedded microcapsules containing fragrances disposed in a fabric sheet that has favorable tactile properties.

Another object is to provide a fragrance sampler that provides effective release of fragrance aroma upon being gently rubbed against the user's skin.

Yet another object is to provide such a sampler that exhibits a pleasant sensation to the user when touching an applicator surface thereof.

Other objects and advantages of the invention will be apparent from the following detailed description and claims appended hereto.

DESCRIPTION OF THE PREFERRED EMBODIMENT

Figure 3:
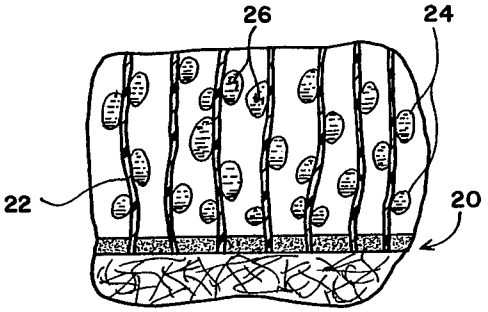
FIG. 3 is an enlarged sectional view showing a portion of the view of FIG. 2.
Figure 1:
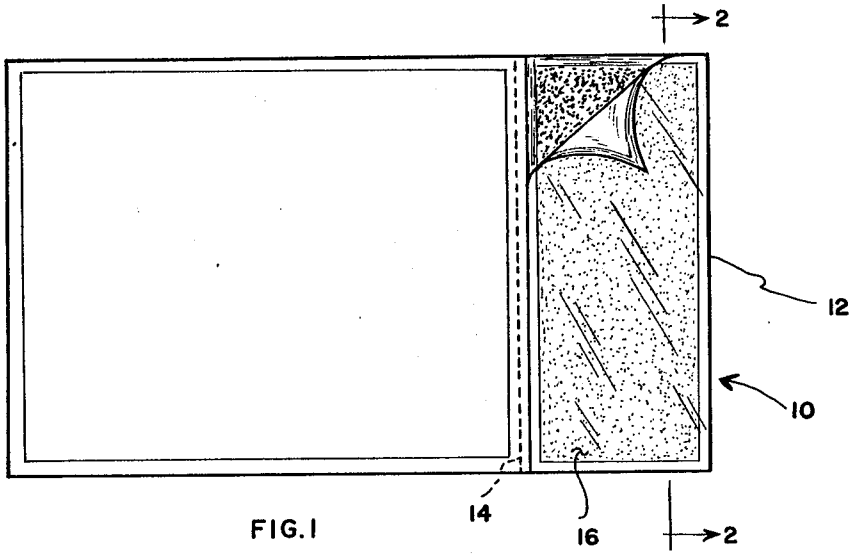
FIG. 1 is a pictorial view of an advertising sampler embodying the invention.

Referring to FIG. 1, there is shown a fragrance sampler 10 secured to and forming a part of an advertising brochure 12 containing printed matter and art work. The sampler is, for example, readily detachable from the rest of the brochure by tearing along perforations 14. Alternately, the sampler may be removably attached to the brochure by means of an adhesive layer. The sampler is enclosed by a plastic film 16 which also is readily removable by tearing and pulling.

Figure 2:
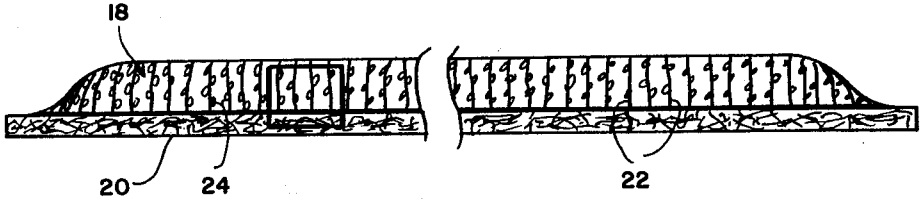
FIG. 2 is a sectional view taken along line 2—2 of FIG. 1.

As shown in FIG. 2, the sampler includes a sheet of snythetic pile fabric 18 having a continuous base sheet 20 to which chopped fibers 22 are adhesively bonded in generally perpendicular relation to the base sheet. Microcapsules 24 containing a fragrance oil or blend of such oils 26 are shown embedded at varying depths between the chopped fibers. The size of microcapsules in this view is exaggerated for purposes of clarity.

A preferred fabric material for use in the sampler is a synthetic pile fabric that has a continuous base sheet of polyethylene and segments 1/16" to 1/32" long of strands or fibers of the same polymeric composition about 20 microns in diameter. Such fabric material may be prepared by flocking methods wherein the base sheet, segments, and adhesive are placed in an electrostatic field so that the segments are aligned perpendicular to the base sheet while being adhesively bonded thereto. Such a fabric material is available commercially from Coburn Corporation under the trademark Vel-Lux TM. This material has a velvet-like texture, presenting a pleasant sensation to human skin when touched. While other fabric materials with a pleasant touch may be used as discussed below, this material is preferred over such materials owing to its chemical inertness, durability, and low cost, consistent with favorable tactile properties.

Other fabric materials which may be employed as the base sheet include velours, felt, and felt-like material; suede and suede-like material; and polymeric foam sheet material. The term "velour" as used herein includes any of a number of textile fabrics having a pile like that of velvet, which may be a silklike fabric having a thick, soft pile of short, erect threads. When the loops of the pile are uncut, the fabric is called pile velvet; and when they are cut so that the pile is of single threads, it is called cut velvet. "Felt" means a cloth fabric made of matted fibers of wool, or wool and fur or hair, worked into a compact form by application of pressure as by rolling, along with heat and moisture. "Felt-like" means a fabric prepared in a manner similar to felt but using synthetic fibers on a backing. "Suede" means a tanned skin, with the flesh side rubbed into a nap. It may be kid or similar material finished with a soft napped surface on the flesh side or on the outer side after removal of a thin outer layer. "Suede-like" means material similar to suede but using synthetic fibers on a backing. "Polymeric foam sheet material" means a thin, soft sheet of foamed polymeric material, such as polyethylene having an openweb structure.

Microcapsules for use in the present invention may be made by a wide variety of known processes. In a preferred process, a fragrance oil or blend of fragrance oils may first be mixed with polymers or other additives in a liquid system to substantially reduce the diffusion rate, volatility and the like of the fragrance, forming a resulting liquid product into droplets or globules and encapsulating the droplets or globules. Further details of this process are disclosed in co-pending application Ser. No. 068,275, filed July 1, 1987, and assigned to a common assignee. Microcapsules for the present fragrance sampler preferably may have an average particle diameter of 5 to 100 microns and include an outer coating of a gelatin composition, the microcapsules being prepared by encasing droplets or particles treated by first reacting fragrance oil with a cellulose-based polymer in a liquid system. In addition to fragrance oils, the microcapsules may be made to contain other substances for application to the skin, for example, other types of cosmetics and medications.

Embedding of microcapsules in the synthetic pile fabric may be readily effected by contacting the pile side of the fabric with a suspension of microcapsules in a liquid such as water so that the microcapsules are deposited among and between pile segments and become adhered thereto. Upon drying, the microcapsules remain adhered in place.

As shown in the drawings, the microcapsule-containing pile fabric sheet is preferably enclosed in a removable plastic film or other barrier material to prevent premature release of fragrance. In addition, a backing sheet may be provided on the back side of the fabric as required for purposes such as stiffening. For the preferred synthetic pile material described above, the polyethylene base sheet provides a barrier preventing chemicals that be contained in a backing sheet from migrating to the microcapsule-containing face of the fabric.

EXAMPLES

An aqueous slurry containing 36 percent by weight of gelatin-walled microcapsules filled with a fragrance oil was contacted with samples of each of the pile fabrics or similar materials given below. After drying, the microcapsule-containing samples were rubbed against the skin, releasing fragrance and imparting a pleasant feel.

Example 1

A synthetic pile fabric having a continuous polyethylene base sheet and flocked polyethylene fiber segments bonded thereto (Vel-Lux TM).

Example 2

A felt-like fabric made of synthetic material.

Example 3

A velour fabric knitted from snythetic filaments.

Example 4

A woven, suede-like fabric made of synthetic material.

Example 5

A foamed polyethylene sheet material having an open-web structure.

Example 6

A synthetic pile material having a paper base sheet and segments of polymeric fabric flocked thereto.

While the invention is described above with reference to a specific embodiment thereof, it will be understood by those skilled in the art that various changes in form and detail may be made without departing from the spirit and scope of the invention as defined in the appended claims.

We claim:

1. A product dispenser comprising a sheet of fabric material presenting a resilient, compressible surface that is pleasant to the human touch and having rupturable uncoated microcapsules containing a product for application to the human skin embedded therein.

2. A fragrance sampler comprising a sheet of fabric material presenting a resilient, compressible surface that is pleasant to the human touch and having rupturable uncoated microcapsules containing a fragrance oil embedded therein.

3. A fragrance sampler as defined in claim 2 wherein said fabric material comprises a synthetic pile fabric.

4. A fragrance sampler as defined in claimed 3 wherein said synthetic pile fabric comprises a base sheet of polyethylene having short segments of polyethylene fiber disposed generally perpendicular to the base sheet, the segments having one of their ends bonded to the base sheet.

5. A fragrance sampler as defined in claim 3 wherein said synthetic pile fabric comprises a base sheet of paper having short segments of synthetic polymeric fiber disposed generally perpendicular to the base sheet, the segments having one of their ends bonded to the base sheet.

6. A sampler as defined in claim 4 wherein said microcapsules have an average diameter of 5 to 100 microns.

7. A sampler as defined in claim 6 including an impermeable film enclosing said sheet of fabric in sealing relation thereto.

8. A sampler as defined in claim 7 including advertising sheet means and means removably securing the same to said fabric sheet.

9. A sampler as defined in claim 2 wherein said fabric comprises felt or felt-like material.

10. A sampler as defined in claim 2 wherein said fabric comprises a velour.

11. A sampler as defined in claim 2 wherein said fabric comprises suede or suede-like material.

12. A fragrance sampler comprising a sheet of fabric material presenting a resilient, compressible surface that is pleasant to the human touch and having embedded therein rupturable, uncoated microcapsules containing a fragrance oil, said microcapsules being embedded by contacting said fabric with an aqueous microcapsule-containing slurry and drying the resulting impregnated fabric.

13. A fragrance sampler as defined in claim 12 wherein said fabric material comprises a synthetic pile fabric.

14. A fragrance sampler as defined in claim 13 including a removable impermeable film enclosing said sheet of fabric in sealing relation thereto.

15. A sampler as defined in claim 14 including advertising sheet means and means removably securing the same to said fabric sheet.

* * * * *